US007802828B2

(12) United States Patent
Hopkins et al.

(10) Patent No.: US 7,802,828 B2
(45) Date of Patent: Sep. 28, 2010

(54) CHILD SAFETY COVER

(75) Inventors: Timothy Paul Hopkins, Round Rock, TX (US); Daniel Russ Dykstra, Augusta, GA (US)

(73) Assignee: Outpace Innovations, LLC, Round Rock, TX (US)

( * ) Notice: Subject to any disclaimer, the term of this patent is extended or adjusted under 35 U.S.C. 154(b) by 0 days.

(21) Appl. No.: 12/381,545

(22) Filed: Mar. 13, 2009

(65) Prior Publication Data

US 2009/0229323 A1 Sep. 17, 2009

Related U.S. Application Data

(60) Provisional application No. 61/036,471, filed on Mar. 14, 2008.

(51) Int. Cl.
*E05C 19/18* (2006.01)
*E05B 3/00* (2006.01)

(52) U.S. Cl. ..... 292/288; 292/348; 292/DIG. 2; 70/209; 70/416; 70/472

(58) Field of Classification Search ..... 292/288, 292/348, DIG. 2; 70/209, 222, 223, 416, 70/422, 472
See application file for complete search history.

(56) References Cited

U.S. PATENT DOCUMENTS

| | | | | |
|---|---|---|---|---|
| 2,587,285 | A | 2/1952 | Broscoe | |
| 2,610,877 | A | 9/1952 | Weaver | |
| 3,109,900 | A | 11/1963 | Van Hook | |
| 3,306,643 | A | 2/1967 | Reed | |
| 3,556,571 | A | 1/1971 | Laub, Jr. | |
| 4,044,579 | A | 8/1977 | Le Bel | |
| 4,082,351 | A | 4/1978 | Chrones | |
| 4,253,690 | A * | 3/1981 | Hollander | 292/354 |
| 4,575,141 | A | 3/1986 | Burns | |
| 5,003,803 | A | 4/1991 | Richards | |
| 5,027,626 | A | 7/1991 | Appelbaum | |
| 5,140,843 | A * | 8/1992 | Krueger | 70/429 |
| 5,193,373 | A | 3/1993 | Hunt | |
| 5,313,812 | A * | 5/1994 | Eklund et al. | 70/416 |
| 5,423,583 | A | 6/1995 | Crockom | |
| 5,651,279 | A | 7/1997 | Berton et al. | |
| 5,671,957 | A | 9/1997 | Raffini | |
| 5,865,050 | A * | 2/1999 | Michaud et al. | 70/416 |
| 5,934,122 | A | 8/1999 | Edwards et al. | |

(Continued)

FOREIGN PATENT DOCUMENTS

| | | |
|---|---|---|
| JP | 4076176 | 3/1992 |

*Primary Examiner*—Carlos Lugo
(74) *Attorney, Agent, or Firm*—Christopher Smyth

(57) ABSTRACT

Various embodiments of the present invention are illustrated. A first embodiment is a safety cover for a deadbolt of a door. The cover includes a housing having a first open end and a second open end. The housing is mounted to the door and positioned to substantially surround the deadbolt with the first open end and to contain a deadbolt actuator knob of the deadbolt within a cavity formed from the housing. The safety cover includes a cap mountable, via the second open end, into snug mating engagement with the interior of the housing. The cap is positioned such that upon actuation the cap slides axially within the housing until an inner wall of the cap meets the deadbolt actuator knob and wherein upon further actuation the inner wall grips and rotates the deadbolt actuator knob.

15 Claims, 6 Drawing Sheets

U.S. PATENT DOCUMENTS 6,324,879 B1 12/2001 Kennedy
6,742,369 B1 6/2004 Veillette
6,769,278 B1 * 8/2004 Chang ..... 70/134
6,854,303 B2 2/2005 Shiao et al.
6,993,944 B2 2/2006 Hicks
7,264,285 B1 9/2007 Ross

* cited by examiner

CHILD SAFETY COVER

CROSS-REFERENCE TO RELATED APPLICATIONS

This application claims the benefit of U.S. Provisional Application No. 61/036,471, filed on Mar. 14, 2008 and entitled "Child Resistant Device for Deadbolt Locks," which is incorporated by reference herein in its entirety.

FIELD OF THE INVENTION

The present invention relates to safety devices for door locks. More particularly the present invention relates to safety covers for deadbolt locks.

BACKGROUND SECTION

Conventional deadbolt locks found on doors, particularly exterior doors, are typically of two types: those with deadbolt actuator knobs and those without. A deadbolt actuator knob is a mechanism on the interior side of the lock that can be manually turned to lock and unlock the deadbolt. Commonly, a key opening is found on the exterior side of the lock so as to receive a key that can open and close the lock. For those locks that do not have deadbolt actuator knobs, the interior side of the lock will often include a second key opening for receiving a key. Actuator knobs have been found to be useful. However, they also pose a safety risk as children can easily manipulate them thereby allowing the child to unlock the door and potentially exiting a home, unsupervised.

Other devices have been created heretofore for addressing similar problems. Notably, Japanese Patent No. JP4076176 to Yutaka and entitled "Push-Pull Turning Lock" (hereinafter, "Yutaka") describes a custom portion to replace the interior of a lock. This device requires a push or pull actuation to lock or unlock the deadbolt. Yutaka is not meant to be attached to a fully-functional, existing deadbolt lock. Further, different deadbolt lock manufacturers have lock shafts in different locations and with different profiles which means Yutaka would not work with most or all existing deadbolts.

Other devices have similar or more noteworthy deficiencies in their function and/or design. There remains a need in the marketplace to provide a user-friendly yet effective safety cover for a deadbolt.

SUMMARY

Various embodiments of the present invention are illustrated in the present disclosure. A first embodiment is a safety cover for a deadbolt of a door. The cover includes a housing having a first open end and a second open end. The housing is mounted to the door and positioned to substantially surround the deadbolt with the first open end and to contain a deadbolt actuator knob of the deadbolt within a cavity formed from the housing. The safety cover includes a cap mountable, via the second open end, into snug mating engagement with the interior of the housing. The cap is positioned such that upon actuation the cap slides axially within the housing until an inner wall of the cap meets the deadbolt actuator knob and wherein upon further actuation the inner wall grips and rotates the deadbolt actuator knob.

A second embodiment of the present invention is a child safety cover for a door lock, the door lock having an actuator knob. The cover includes a housing and a cap mountable into snug mating engagement with an interior of the housing. The cap is positioned such that upon actuation the cap slides within the housing until the cap meets the actuator knob and wherein upon further actuation the cap rotates the actuator knob.

A third embodiment of the present invention is a safety cover for a deadbolt of a door. The cover includes means for confining a thumb-turn of the deadbolt within a cavity and means for actuating the thumb-turn. The means for actuating snugly engages the means for confining at an open end of the means for confining. The means for actuating is positioned to slide axially within the means for confining and upon meeting the thumb-turn effectively rotates the thumb-turn.

BRIEF DESCRIPTION OF THE DRAWINGS

The accompanying drawings incorporated in and forming a part of the specification, illustrate several aspects of the present invention, and together with the description serve to explain the principles of the invention.

DETAILED DESCRIPTION

In the following description, for purposes of explanation, numerous specific details are set forth in order to provide a thorough understanding of the present invention. It will be evident, however, to one skilled in the art that the present invention may be practiced without these specific details.

Figure 1:
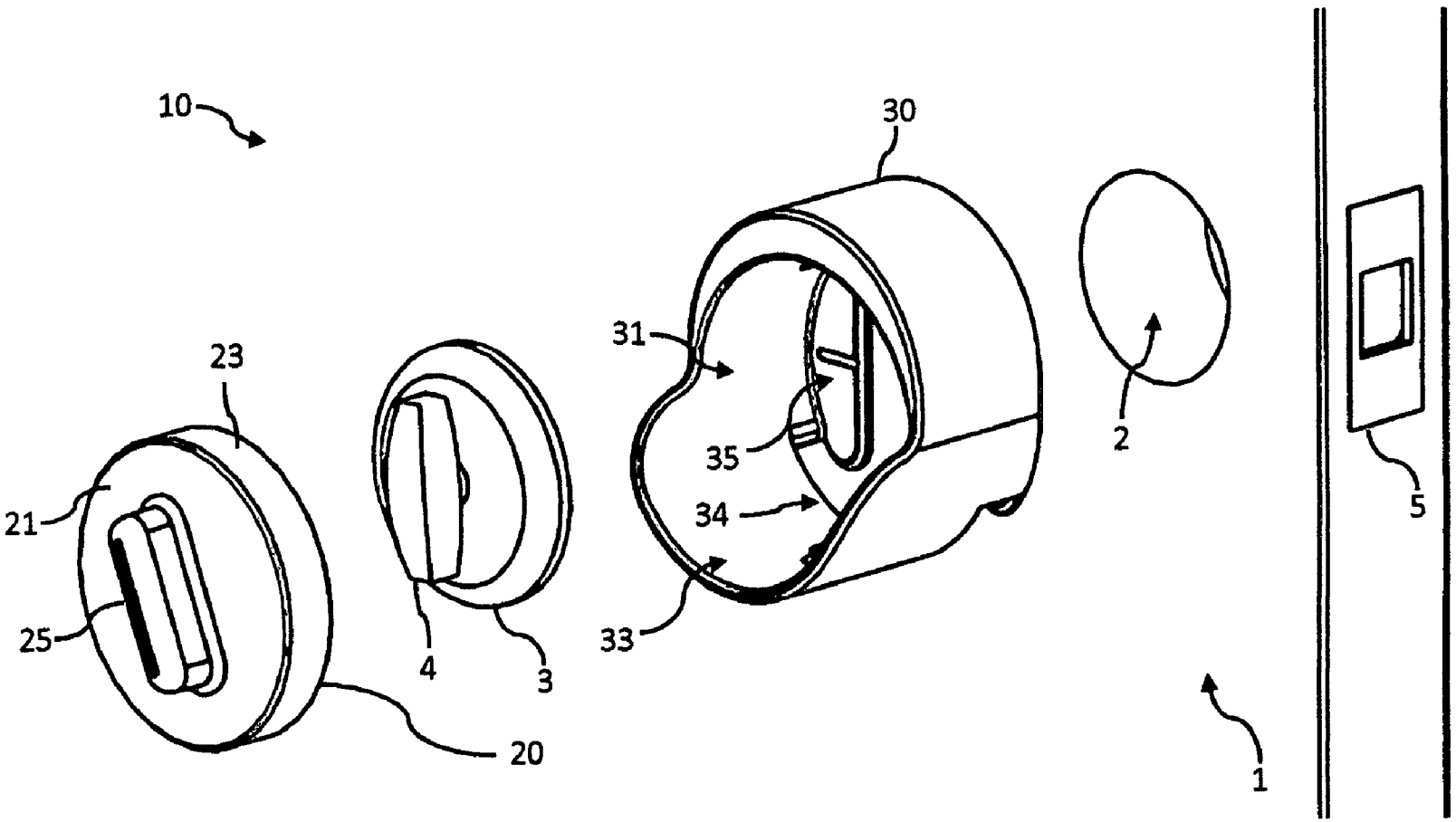
FIG. 1 illustrates an exploded perspective view of a first embodiment of the safety cover mounted to a door.

Turning now to FIG. 1, illustrated is an exploded perspective view of a first embodiment of the safety cover 10 mounted to a door 1. Door 1 includes a hole 2 for receiving a deadbolt lock (lock cylinder not shown). A deadbolt actuator knob 4 is coupled to the face plate 3 of the lock. As is well understood, the deadbolt actuator knob 4, or sometimes referred to as a thumb-turn, mates with the lock cylinder upon install. Rotation of the actuator knob 4 initiates a latch 6 to move in a lateral position by passing through a strike plate 5, thus effectively locking or unlocking the deadbolt lock. While a deadbolt lock has been illustrated throughout, it will be appreciated by those skilled in the art that the present invention can be applied to a number of locks wherein a rotatable actuator knob is utilized to lock and unlock the lock. For example, the safety cover illustrated herein may be implemented on a standard door knob with thumb-turn lock.

Figure 2:
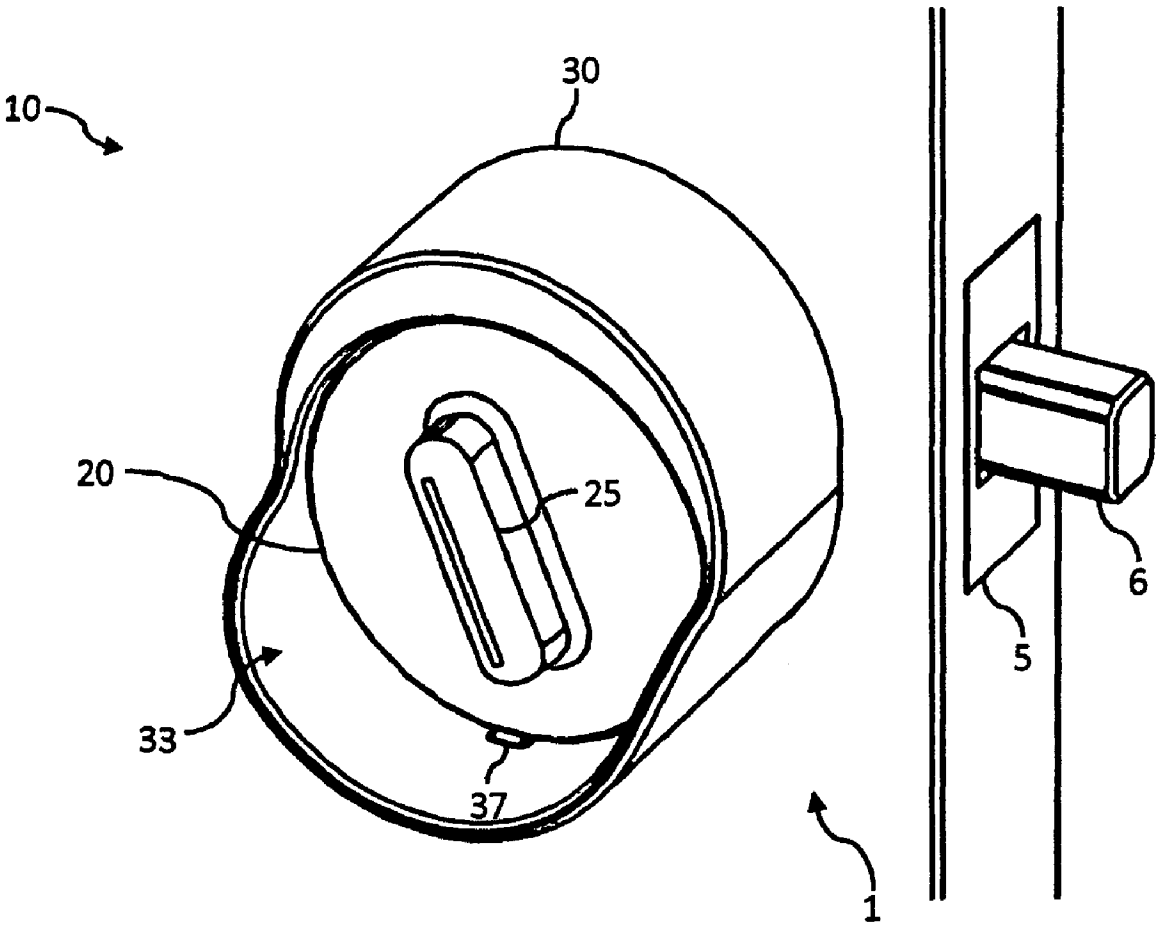
FIG. 2 illustrates a perspective view of the safety cover mounted to the door.

A housing 30 of the safety cover 10 is positioned to extend perpendicularly away from the door 1. Housing 30 is designed to be pressed against the door 1 and the face plate 3 of the lock (illustrated further in subsequent figures). The housing 30 is formed to confine or contain the face plate 3 and actuator knob 4 within a hollow cavity of the housing 30. A cap 20 of the safety cover 10 is designed to fit within the cavity of the housing 30 thereby preventing immediate access to the actuator knob 4 (See FIG. 2). Once confined by the housing 30, actuator knob 4 becomes more difficult to access and manipulate, particularly for a child.

In this embodiment housing 30 is a generally cylindrical shape designed to match the generally circular contour of most deadbolts. Housing 30 is formed such that both ends are open. A first open end allows for the face plate 3 and actuator knob 4 to meet the lock cylinder. A second open end is positioned to receive the cap 20.

In other embodiments, housing 30 may take on other shapes, such as a more squared shape, although the interior side wall 31 would preferably remain relatively cylindrical or tubular.

Housing 30, in this embodiment, has a protruding section 33 of its side wall. Here, the protruding section 33 is the bottom portion of the housing 33 and is designed to make access more difficult to the cap 20 for children. In other embodiments, the housing 30 may not include the protruding section 33.

Figure 3:
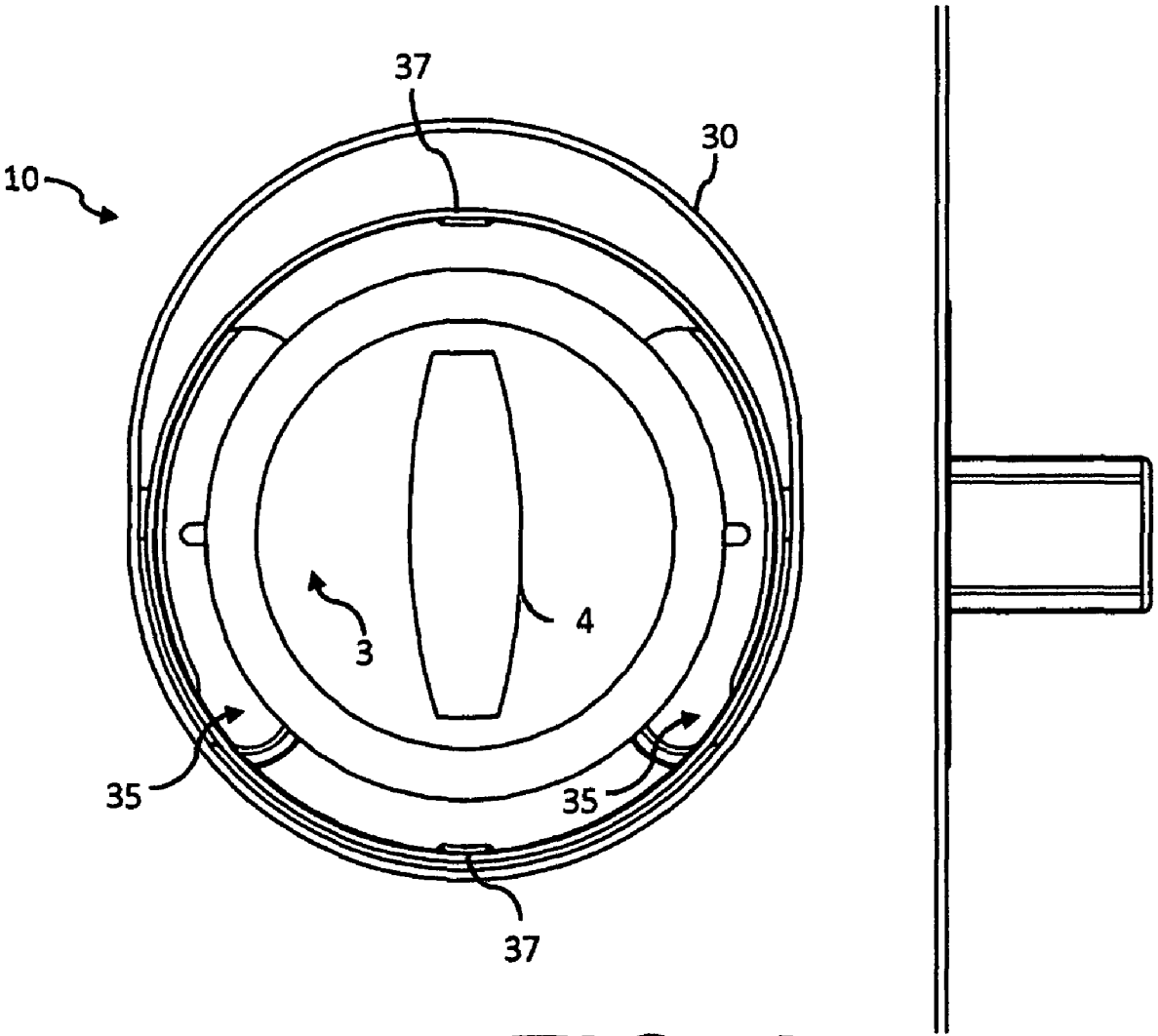
FIG. 3 illustrates a front view of the housing of the safety cover mounted to the door.

Two lips 35 extend radially inward from the side wall 31 at the first open end of the housing 30. In practice, the lips 35 are positioned securely between the door 1 and the face plate 3, upon mounting of the face plate 3. As best illustrated in FIG. 3, lips 35 are arcuate in shape thus allowing for vertical movement of the housing 30 relative to the face plate 3 and actuator knob 4. Upon installation, it is preferred that the housing 30 be positioned so as to align the axis of rotation of the cap 20 with the axis of rotation of the actuator knob 4. In some models of deadbolts, the axis of rotation of the actuator knob 4 may be offset from the center of the deadbolt. In other embodiments, the lips 35 may be formed to allow horizontal variance in the positioning of the safety cover 10 relative to the deadbolt lock. Furthermore, lips 35 may extend 360° from the side wall 31 of the housing 30 thus providing minimal horizontal or vertical variance in the positioning of the housing 30.

Figure 4:
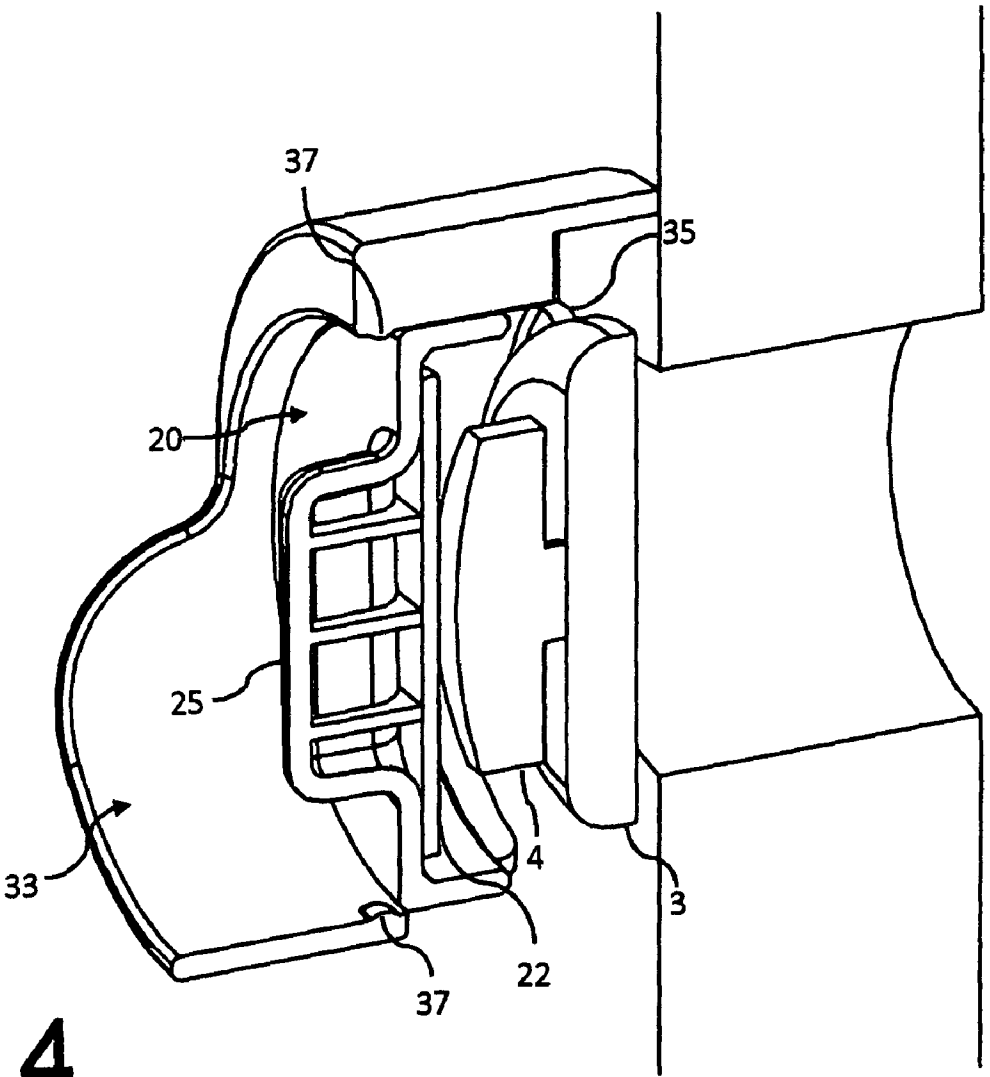
FIG. 4 illustrates a sectional view of the first embodiment of the safety cover.
Figure 5:
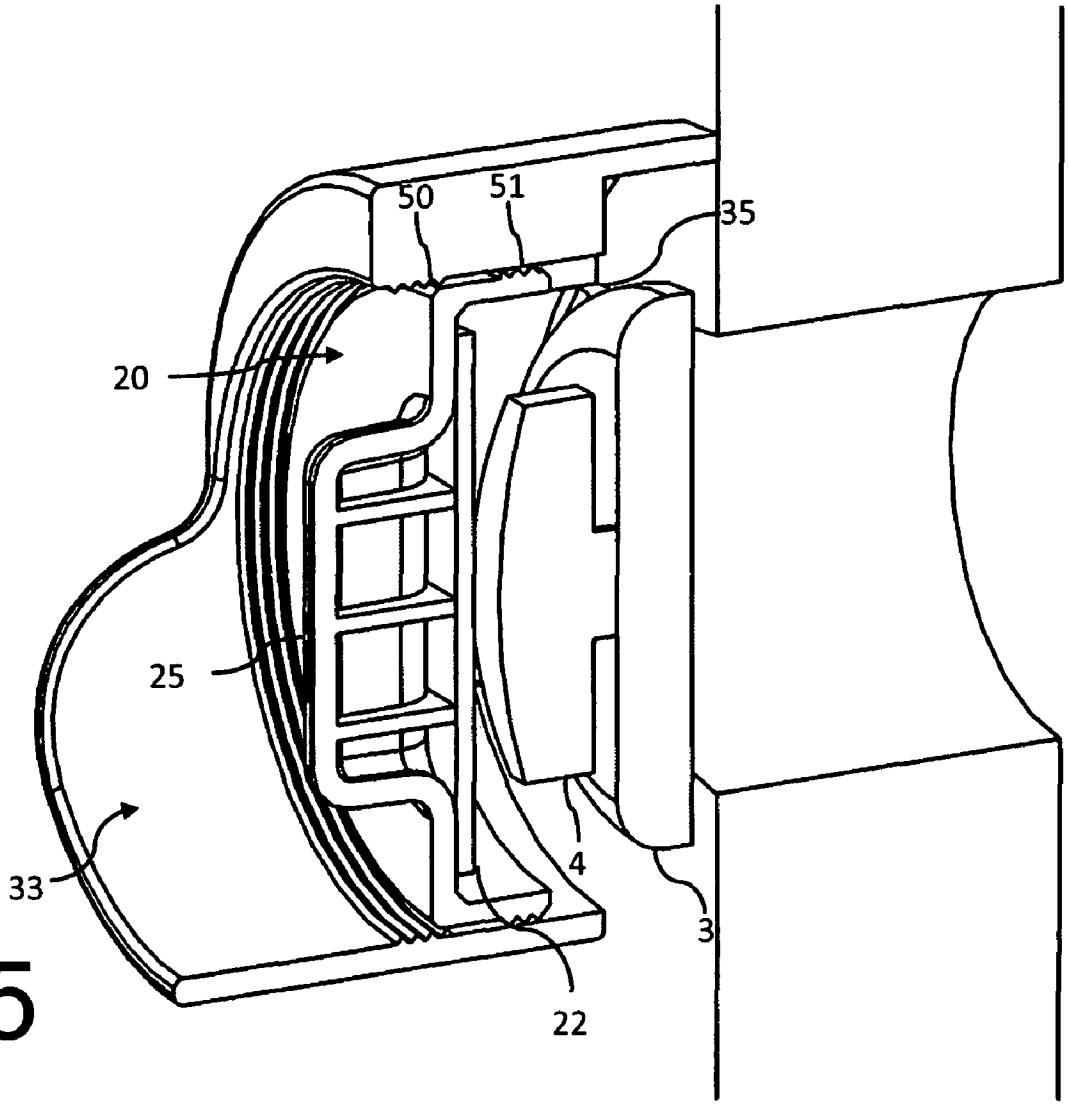
FIG. 5 illustrates a sectional view of a second embodiment of the safety cover.

Friction bumps 37 are formed and extend radially inward from the interior side wall of the housing 30 (as seen in FIG. 3 and FIG. 4). Upon installation, as the cap 20 is placed within the first open end of the housing 30, the cap 20 must slide past the friction bumps 37. Once past, the cap 20 is safely secured. One or more friction bumps 37 could be utilized to secure the cap 20. In other embodiments, mating threads 50 and 51 on the housing 30 and the cap 20 could be used to secure the cap 20 into place (as seen in FIG. 5). A limited number of rotations of the threads would allow the cap 20 to be properly secured (and prohibit the cap 20 from falling out) yet still allow horizontal movement of the cap 20 as needed (once the threads 51 of the cap 20 pass the mating threads 50 of the housing 30). A number of other approaches for retaining the cap 20 within the housing 30 could be utilized aside from the approaches mentioned above. For example, the cap 20 could be snapped into place and remain within the housing 30 until snaps were pressed thus releasing the cap 20 from the housing 30.

Housing 30 may be manufactured from a number of materials including durable plastic or rubber. It is envisioned that housing 30 would be molded as a single part, although it may be possible to manufacture the housing 30 into multiple parts and assemble them together. This may be advantageous for manufacturing efficiency or packaging optimization. It should be appreciated by those skilled in the art that the spirit of the invention does not lie in whether the housing 30 is formed of a single piece or multiple pieces assembled together.

Cap 20, in this embodiment, has a circular shape to mate snugly within the contour of the interior side wall 31 of the housing 30. Cap 20 includes an outer face 21 and a side wall 23. Cap 20 also includes an inner face 22, which is best illustrated in FIG. 4.

A protrusion 25 may be formed from the outer face 21 to provide for a user to more easily rotate the cap 20 when necessary. The protrusion 20, in this embodiment, is a narrow, generally rectangular protrusion. The protrusion 20, however, could take on a number of different shapes without departing from the spirit of the invention. Alternatively, cap 20 may not have a protrusion 20 at all.

Cap 20 may be manufactured of a number of materials most preferably durable plastic or rubber. It is envisioned that cap 20 may be generally opaque or generally transparent. In some embodiments, some transparency in the cap 20 may allow a user to see the position of the actuator knob 4. Cap 20 may be formed of a singular part or formed of multiple parts and assembled together. For example, the inner face 22 of the cap 20 may be positioned within a recess of the cap 20 (as best illustrated in FIG. 4) and still provide the necessary functionality. The inner face 22 may be manufactured from different material than the cap 20. For example, the inner face 22 may be made from a material with a higher coefficient of friction than the material from which the cap 20 is made.

In practice, once the housing 30 is properly mounted between the door 1 and the face plate 3 of the deadbolt lock, the cap 20 can be positioned with the second open end of the housing 30 so as to effectively seal the actuator knob 4 within the safety cover 10. As mentioned, the cap 20 may be inserted into the second open end of the housing 30 such that the cap 20, with some force, slides past the friction bumps 37. Once in position, a user can effectively lock or unlock the deadbolt lock by pushing the cap 20 toward the door 1, until the inner face 22 meets the actuator knob 4. As visible in FIG. 4 some space is provided to allow for the axial movement of the cap 20, within the housing 30.

Once the inner face 22 of the cap 20 meets the actuator knob 4, the user can then rotate the cap 20 in order to rotate the actuator knob 4 in either the clockwise or counter-clockwise direction. The material in which the cap 20, and in particular the inner face 22 of the cap 20, is manufactured is important. The material should effectively "grip" the actuator knob 4, thus a material with considerable friction is preferable. Although not illustrated in these embodiments, protrusions may extend from the inner face 22 of the cap 20 in order to effectively grip the actuator knob 4.

It should be appreciated by those skilled in the art that the embodiments of the present invention make it more difficult for a child to unlock (or lock) a deadbolt lock, by adding some complexity to the process of rotating the actuator knob 4. One of the primary features of the present invention is that the safety cover 10 is a wholly separate device from the lock itself, thus not requiring much for installation. It should be noted that the present invention, upon installation does not affect a user in his or her ability in locking or unlocking the deadbolt lock from the outside (ie., with a key), as the safety cover 10 provides no resistance to the actuator knob 4 when no user force is applied.

Figure 6:
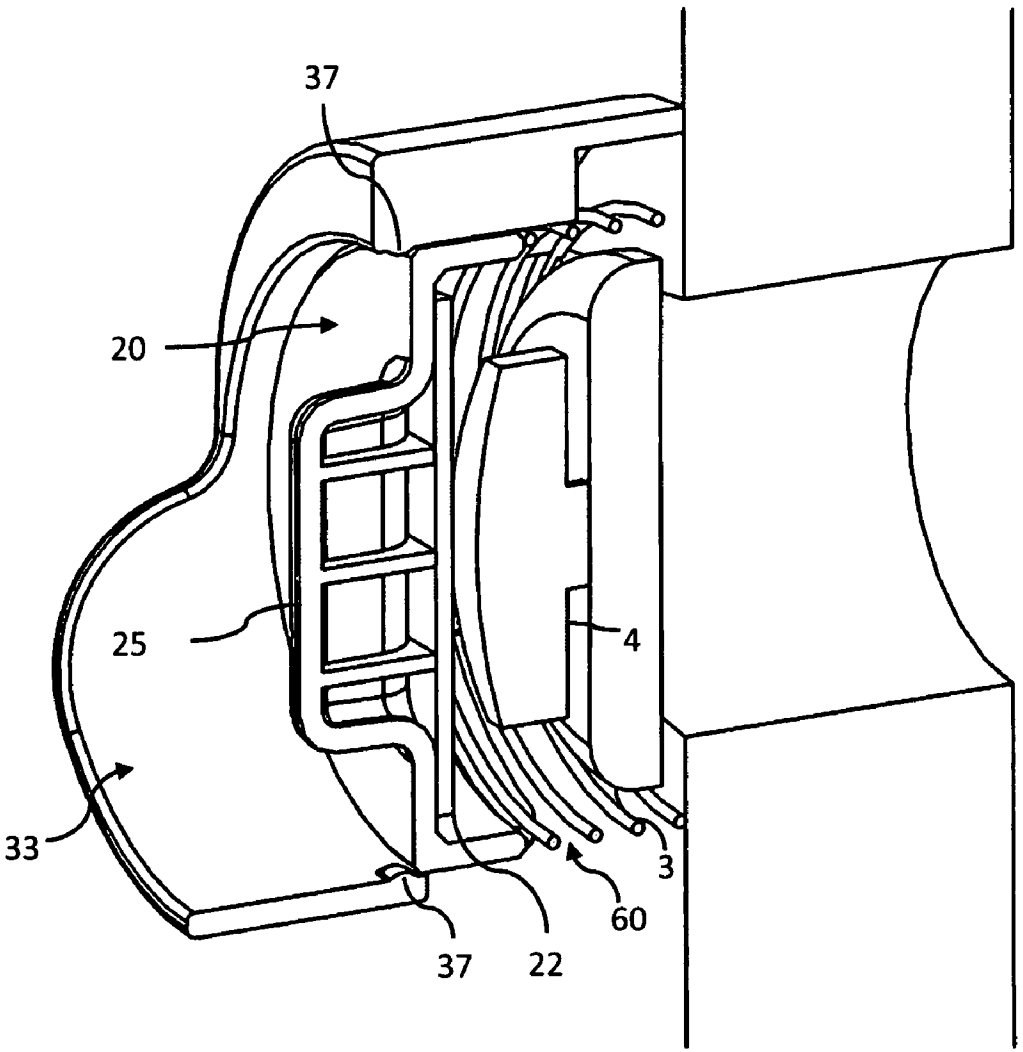
FIG. 6 illustrates a sectional view of a third embodiment of the safety cover.

The embodiments as illustrated herein do not include any means for resetting the cap 20 away from the actuator knob 4, once a user completes the task of rotating the knob 4. As illustrated in the figures there is sufficient space for the cap 20 to retreat once any user force is removed. However, in other embodiments, approaches for forcing the cap 20 to retreat away from the actuator knob 4 could be implemented. For example, a compression spring 60 placed between the cap 20 and the door 1 and contained within the cavity formed by the housing 30 could effectively apply a force that would reset the cap 20 away from the actuator knob 4 (as seen in FIG. 6). Alternatively, the housing 30 could be designed with a generally conical shape with diameter decreasing towards the end mated with the door 1. In this case, the cap 20 may have spring fingers integrated within that would meet the conical shape of the housing 30, and with force from a user continue to allow axial movement of the cap 20 towards the actuator knob 4. Upon removal of this force, the cap 20 would retreat back away from the actuator knob 4.

It should be emphasized that the above-described embodiments of the present invention, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention and protected by the following claims.

The invention claimed is:

1. A safety cover for a deadbolt assembly of a door, said cover comprising:

a housing, comprising:

a first open end and an opposed second open end; and a housing sidewall formed to create a cavity extending from said first end to said second end, said housing mounted to said door and positioned to substantially surround and contain a deadbolt actuator knob of the deadbolt assembly within the cavity; and a cap comprising a face plate with outer and inner faces, said cap mountable through said second open end into snug mating engagement with an inside of said housing sidewall, and secured within said housing and positioned spaced from the deadbolt actuator knob, and wherein when said cap is only rotated, said inner face is not engaged to the deadbolt actuator knob, therefore, no movement is transferred to the deadbolt assembly, and wherein when said cap is first slidably moved into the cavity and then rotated, said inner face engages the deadbolt actuator knob to operate the deadbolt assembly.

2. The safety cover of claim 1, wherein said housing comprises:

inward lips at the first open end, said lips positioned to be securely engaged between the door and a face plate of the deadbolt so as to effectively mount said housing to the door.

3. The safety cover of claim 2, wherein said inward lips form an incomplete perimeter such that the vertical positioning of said housing, relative to the deadbolt, can be adjusted to align with the axis of rotation of the deadbolt actuator knob.

4. The safety cover of claim 1, wherein said housing comprises a tubular side wall.

5. The safety cover of claim 4, wherein said tubular side wall of said housing extends axially further away from the door for a portion of the circumference of said housing.

6. The safety cover of claim 1, wherein said cap is comprised of a generally transparent material.

7. The safety cover of claim 1, wherein said cap further comprises:

a protrusion formed on an said outer wall of said cap for a user to effectively grip and rotate.

8. The safety cover of claim 4, wherein said housing further comprises:

at least a first friction bump formed and extending inwardly from the interior of said tubular side wall, said at least first friction bump positioned to secure said cap upon being slidably mounted within said housing.

9. The safety cover of claim 1, wherein said housing and said cap comprise mating threads such that said cap first engages said housing upon being rotated within said threads.

10. The safety cover of claim 1, further comprising:

a compression spring between said cap and the door and contained within the cavity formed by the housing, said compression spring positioned to provide axial resistance to said cap.

11. A child safety cover for a door lock, the door lock having an actuator knob, said cover comprising:

a housing; and a cap mountable into snug mating engagement with an interior of said housing, said cap positioned such that when said cap is only rotated, said cap is not engaged with the actuator knob, therefore, no movement is transferred to the door lock, and wherein when said cap is first slidably moved within said housing and then rotated, said caps engages the actuator knob to operate the door lock.

12. The safety cover of claim 11, wherein said housing comprises:

inward lips at a first end, said lips positioned to be securely engaged between the door and a face plate of the lock so as to effectively mount said safety cover to the door.

13. The safety cover of claim 12, wherein said inward lips form an incomplete perimeter such that the vertical positioning of said housing, relative to the lock, can be adjusted to align with the axis of rotation of the actuator knob.

14. The safety cover of claim 11, wherein said cap is comprised of a generally transparent material.

15. The safety cover of claim 11, wherein said cap comprises:

a protrusion formed on an outer wall of said cap for a user to effectively grip and rotate.

* * * * *